United States Patent [19]

Cutter

[11] 4,311,380

[45] Jan. 19, 1982

[54] AUTOMATIC PROCESSOR FOR DENTAL X-RAY FILM

[75] Inventor: James W. Cutter, Hollister, Calif.

[73] Assignee: DFP Enterprises, Oakland, Calif.

[21] Appl. No.: 196,013

[22] Filed: Oct. 10, 1980

[51] Int. Cl.[3] ..... G03D 3/10

[52] U.S. Cl. ..... 354/322; 134/64 P

[58] Field of Search ..... 354/315, 316, 319, 320, 354/321, 322, 338, 339; 134/64 P, 122 P

[56] References Cited

U.S. PATENT DOCUMENTS

| | | | |
|---|---|---|---|
| 2,689,729 | 9/1954 | Debrie | 354/321 |
| 3,662,665 | 5/1972 | Meeussen et al. | 134/64 P |
| 3,882,527 | 5/1975 | Sawada et al. | 354/322 |

*Primary Examiner*—L. T. Hix
*Assistant Examiner*—Alan Mathews
*Attorney, Agent, or Firm*—Claude A. S. Hamrick

[57] ABSTRACT

An apparatus for the automatic processing of dental x-ray film having a horizontally disposed spiralling film processing chamber (14) such that fluid retaining tanks (16), (18), (20) and (22) are created by the lower portion of each spiralling revolution, the sidewalls (40) and (42) of the spiralling chamber having pairs of opposing arcuate film travelling grooves (44) and (45), a central shaft (32) rotates along the principle axis of the spiralling chamber (14) and film impellers (50), (52), (54), (56) and (60) are rotated by the shaft (32) for impelling film (43) along the grooves (44) and (45) through said spiralling chamber (14).

13 Claims, 10 Drawing Figures

AUTOMATIC PROCESSOR FOR DENTAL X-RAY FILM

BACKGROUND OF THE INVENTION

1. Field of the Invention

The present invention relates generally to devies for processing x-ray film and more particularly, to a device for the automatic processing of dental x-ray film.

2. Description of the Prior Art

Many devices have been developed for the automatic processing of dental x-ray film. Typically, such devices have a series of tanks containing developer, fixer and water wash and a means for automatically transporting the film from one tank to another. The film transport means has typically been complicated and therefore subject to jamming and malfunction. One such device depicted in U.S. Pat. No. 3,882,525, issued May 6, 1975 to Ernst Zwettler, depicts a device for transferring film from one tank to another along a comlicated rising the falling path. A large number of wheels, gears, levers and other moving parts are required to successfully transport the film from the entry port to the exit port.

There is therefore an unfilled need for an automatic dental x-ray film processing device which has few moving parts such that maintenance is simplified and the danger of malfunction and jamming is kept to a minimum.

SUMMARY OF THE INVENTION

It is therefore an object of the present invention to provide an automatic dental x-ray film processor having a minimal number of moving parts such that the danger of malfunction and jamming is kept to a minimum.

It is another object of the present invention to provide an automatic dental x-ray film process having few parts whereby manufacture and assembly is simplified.

It is a further object of the present invention to provide an automatic dental x-ray film processor which is inexpensive to manufacture and easy to use.

The automatic dental x-ray film processor of the present invention includes a horizontally disposed spiralling chamber which makes approximately four revolutions. The lower portion of each spiral is utilized as a fluid holding tank, for such fluids as developer, fixer, water wash and air for drying the film. The inner sidewalls of the spiralling chamber are generally parallel to one another and have opposing pairs of film transport grooves formed therein. A series of film impeller arms radiate from a rotating central shaft and operate to push the dental x-ray film sequentially through each of the fluid holding tanks making up the spiralling chamber. A means is provided for returning the impellers to an initial position following each 360° revolution of the impellers through the spiralling chamber. The sidewalls of the spiralling chamber are designed such that one element comprising but a portion of a spiralling chamber may be repeatedly joined to others of its kind to create the entire spiralling chamber. Thus, the manufacture of the single element permits the assembly of the entire chamber and manufacture and assembly costs are held to a minimum.

An advantage of the automatic dental x-ray film processor is that it has few moving parts whereby malfunction and jamming problems are minimized.

Another advantage of the automatic dental x-ray film processor is that it requires few parts for assembly such that manufacture and assembly costs are held to a minimum.

It is a further advantage of the automatic dental x-ray film processor that it is quick and easy to use.

IN THE DRAWINGS

DESCRIPTION OF THE PREFERRED EMBODIMENT

Figure 1:
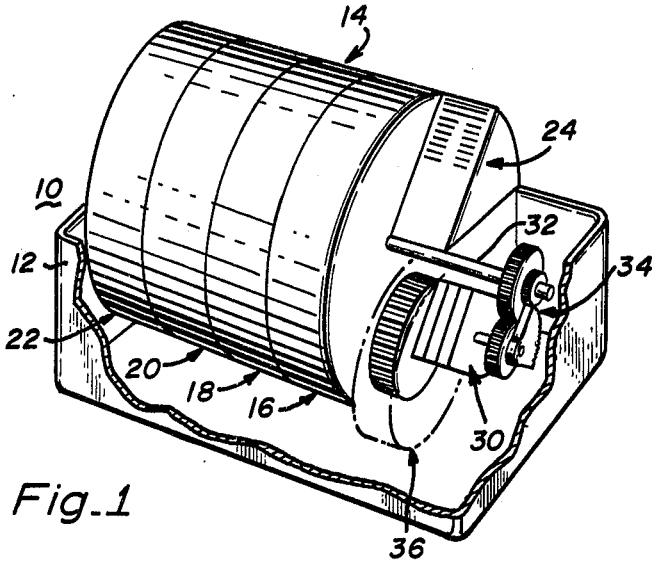
FIG. 1 is a front perspective view of the automatic dental x-ray film processor of the present invention.
Figure 2:
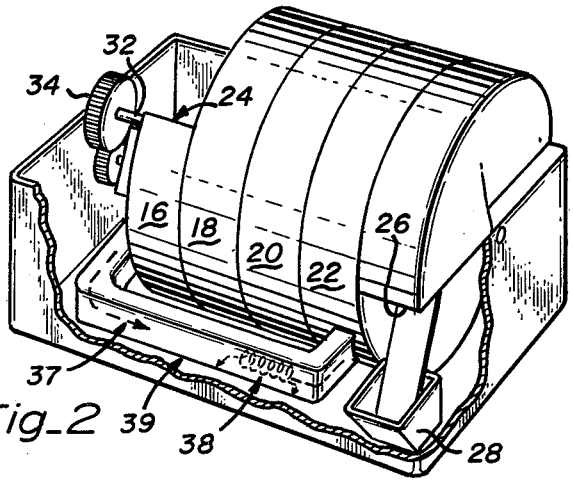
FIG. 2 is a rear perspective view of the present invention.

As depicted in FIGS. 1 and 2, the automatic processor for dental x-ray film of the instant invention 10 includes an outer tray 12 which supports and contains a spiral chamber 14 through which the film travels during processing. The chamber 14 makes approximately four revolutions such that four tanks are created. A first tank 16 holds developer fluid, a second tank 18 holds fixer fluid, a third tank 20 holds water wash and a fourth tank 22 functions as a drying tank and holds no liquid. Film is placed into the device at the film loading section 24 and is ejected from the device at the exit port 26 to fall into the holding tray 28. A motor 30 is provided to rotate a center shaft 32 by means of a two speed gearing system 34. An airblower 36 is also operated by the motor 30 to provide air to the drying tank 22, and a heating element 38 is located in the air duct 39 to heat the air 37 from the air blower 36 prior to its entry into the drying tank 22. As will further appear, each of the tanks 16, 18, 20 and 22 is formed by a lower section of the spiralling chamber 14 which holds fluid. An upper section of the spiralling chamber forms a cross-over section between two adjacent lower sections.

Figure 3:
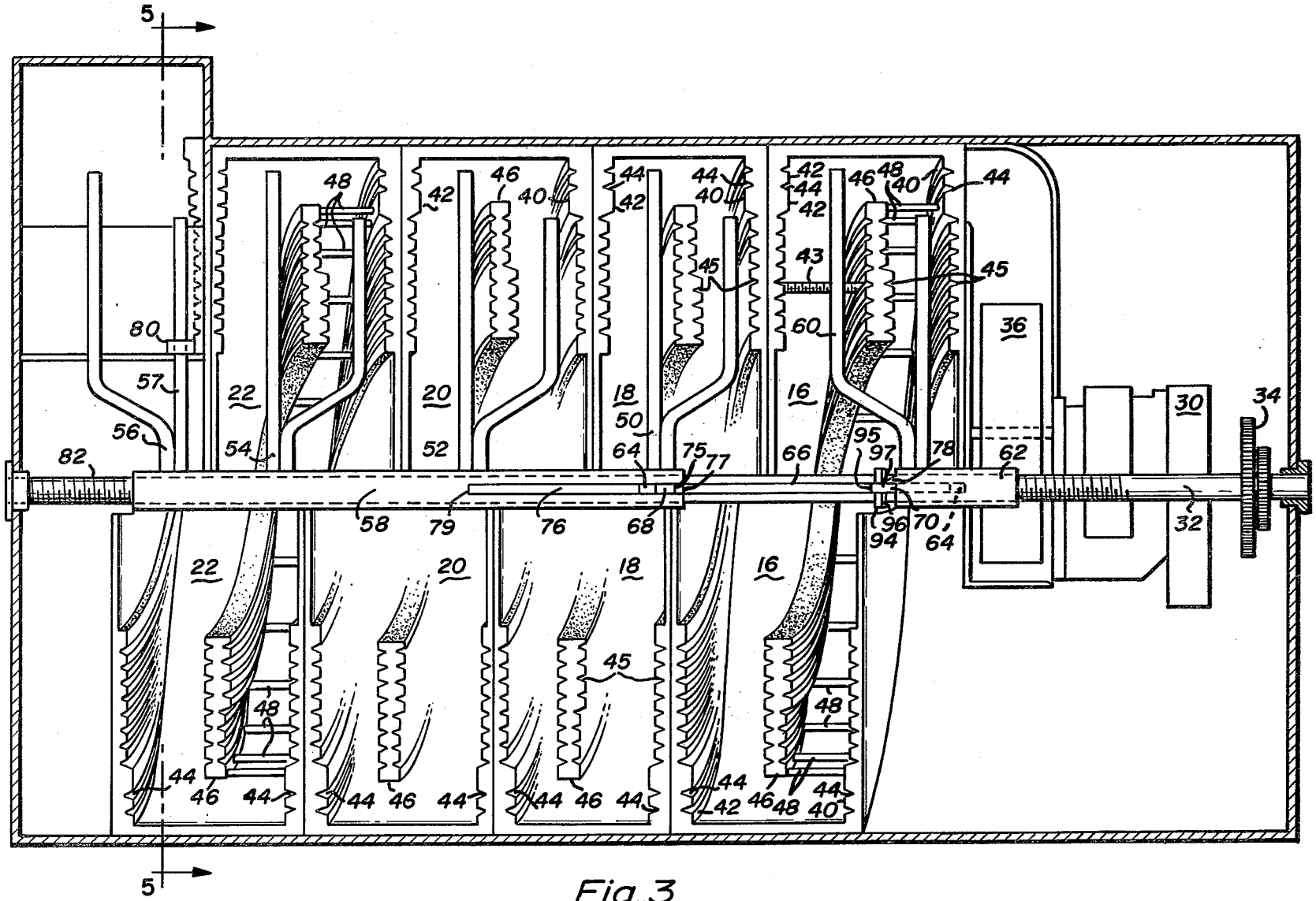
FIG. 3 is a top plan view of the present invention with the top half thereof removed.

FIG. 3 depicts a top plan view of the device with the top of each of the tanks removed. The spiralling film chamber 14 is defined by generally parallel sidewalls 40 and 42 which have corresponding pairs of film guide grooves 44 formed therein. It is to be appreciated that the sidewalls and film guide grooves of each tanks 16, 18, 20 and 22 are identical although only the grooves in the developer tank 16 and dryer tank 22 are shown in detail. A single film slide 43 is shown disposed in a pair of film guide grooves in developer tank 16. It is to be realized that in operation, film could be located in all such pairs of grooves.

A mid-chamber wall 46 is provided to increase the film processing capacity of the device and to allow for the simultaneous processing of several different sizes of film. The varying distances between pairs of slots such as 44 and 45 define the different sizes of film that may be processed. The mid-chamber wall 46 is fixably attached to the chamber sidewall 40 through pegs 48 which emanate from the side of the mid-chamber wall 46 at the circumference thereof, and are joined to the sidewall 40 at various points therealong. The mid-chamber walls 46 have a large opening 49 in the center thereof to allow for the rotational movement of the impeller arms as is described hereinbelow.

Four film impeller arms, 50, 52, 54 and 56 are fixed to a sleeve 58 which is slideably mounted on the pegs 48 which emanate from the side of the mid-chamber wall 46 at the circumference thereof, and are joined to the sidewall 40 at various points therealong. The mid-chamber walls 46 have a large opening 49 in the center thereof to allow for the rotational movement of the impeller arms as is described hereinbelow.

Four film impeller arms, 50, 52, 54 and 56 are fixed to a sleeve 58 which is slideably mounted on the central shaft 32. Each impeller arm has two fingers which project radially from sleeve 58, and each impeller arm lies in the same plane, radially extending from sleeve 58. A loading impeller 60 is fixably mounted to sleeve 62 which is slideably mounted on central shaft 32. It will therefore be appreciated that the four impellers 50, 52, 54 and 56 act in unison with the movement of sleeve 58, while movement of the loading impeller 60 is governed by movement of sleeve 62.

Figure 4:
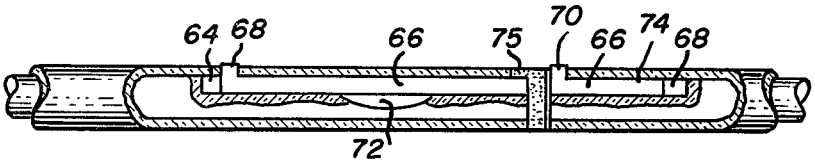
FIG. 4 is a partially cross sectional view of the central shaft of the present invention.

The interaction of the sleeves 58 and 62 with the central shaft 32 is best explained with the aid of FIG. 4. As depicted in FIGS. 3 and 4, the central shaft 32 has a keyway 64 cut therein. A loose fitting, slideable key 66 is located in keyway 64, and is formed with a slow engaging projecting member 68 and a dog engaging projecting member 70. Additionally, keyway 64 is formed with a recessed area 72 to aid in assembly of the key 66 and sleeve 58 upon the central shaft, and key 66 is formed with projection 74 which aids in retaining the key 66 in the keyway 64 during the lateral movement of the key 66 in the keyway 64 upon operation of the device, as will hereinafter be described. As is best seen in FIG. 3, sleeve 58 is formed with a slot 76 for engaging projecting member 68 and sleeve 62 is formed with an axially extending dog 78 for engaging projecting member 70. It is to be realized that when the center shaft 32 is rotated, projecting member 68 will engage the side of slot 76 and cause sleeve 58 to rotate, whereby the impellers 50, 52, 54 and 56 will be caused to rotate.

A wheel 80, located on finger 57 of impeller 56, makes rolling contact along the sidewall of drying tank 22. As the sidewall of drying tank 22 is formed as a spiral, upon rotation of the impellers, wheel 80, by virtue of its contact with the sidewall of the drying tank will cause the sleeve 58 and each of the impellers 50, 52, 54 and 56 engaged therewith to be moved laterally along central shaft 32 in a leftward direction. Thus, it is seen than upon clockwise rotation of the central shaft 32 that the impellers 50, 52, 54 and 56 will both rotate and move laterally leftward, thereby traveling a spiralling course within the spiralling chamber 14. Coil spring 82 is provided along central shaft 32 to resist the lateral motion of sleeve 58 and to eventually impel sleeve 58 in a rightward direction to its starting position. A shock adsorber 94 is formed around central shaft 32 to cushion the rightward movement of sleeve 58 and snap ring 96 is placed on central shaft 32 between the shock adsorber 94 and sleeve 62 to isolate the rotation of the two sleeves 58 and 62 from one another. A coil spring 63 is provided along central shaft 32 to urge sleeve 62 leftward to maintain the engagement of dog 78 with projecting member 70.

Figure 5:
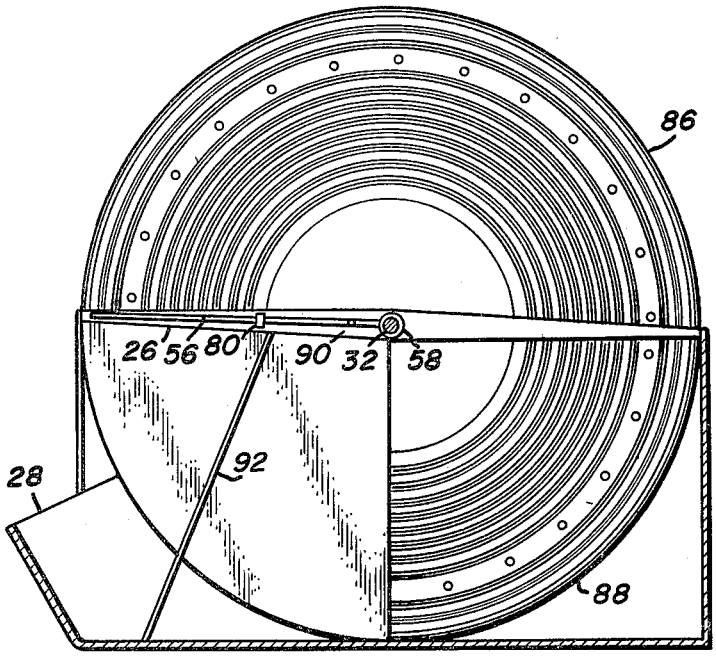
FIG. 5 is a cross sectional view taken along lines 5—5 of FIG. 3.

FIG. 5 presents a cross sectional view taken along lines 5—5 of FIG. 3. The output tray 28 is shown in the lower left hand guadrant of this Fig. However, due to the spiral nature of the device the remaining quadrants show portions of the top cross over section 86 and a lower section 88 comprising the drying tank 22. Upper section 86 and lower section 88 are designed to fit together to form an impeller return slot 90 between the joining sidewalls of the two sections 86 and 88. Return slot 90 is designed to permit the passage of center shaft 32, sleeve 58 and the impellers attached thereto, and impeller 56 is shown displaced in slot 90 with wheel 80 attached thereto. A film exit is joined to the exit port 26 to guide processed film into the output tray 28.

As has been noted, when the impellers 50, 52, 54 and 56 are rotating, wheel 80, by virtue of its rotational contact with the sprialling sidewall, compels sleeve 58 to move leftward against spring 82. It is to be appreciated that when wheel 80 moves into slot 90, as depicted in FIG. 5, the force of spring 82 will cause sleeve 58 and the impellers attached thereto to move laterally to the right. It is therefore to be appreciated that FIG. 3 depicts the configuration of the device immediately prior to wheel 80 entering slot 90, and that FIG. 4 depicts the central shaft 32 immediately after sleeve 58 has moved laterally to the right.

Figure 6:
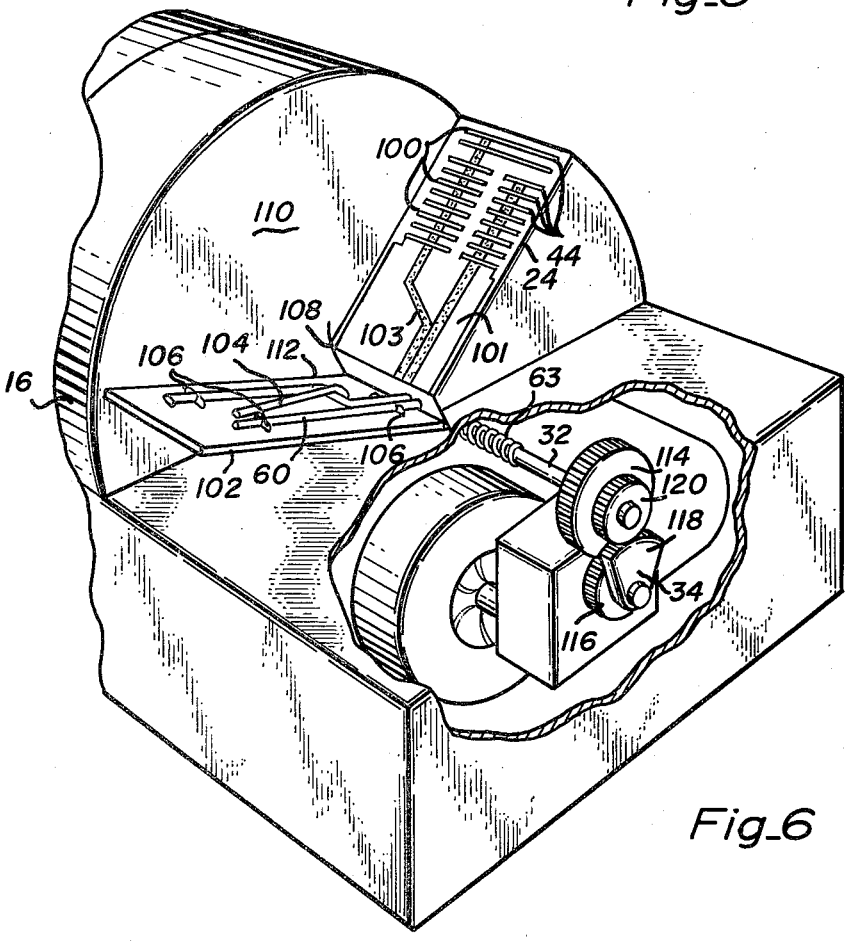
FIG. 6 is a front perspective view showing the loading mechanism of the instant invention and the two speed gearing arrangement utilized therein.

FIG. 6 is a perspective view illustrating the loading of the device. Film 100, shown in various sizes, is manually loaded into the guide grooves 44 formed in the front plate 101 of the film loading section 24. A guide channel 103 is formed in front plate 101 to permit the passage of loading impeller 60 therethrough. Loading door 102 is engaged to the loading impeller 60 utilizing flat spring 104 and guides 106. An outwardly projecting section 108 is formed in the outer sidewall 110 of the developer chamber 16 and makes sliding contact with the inner edge 112 of the loading door 102. The effect of this sliding contact is to cause the loading door 102 to slide to the right when it is opened, whereupon loading impeller 60, attached thereto, and sleeve 62 to which it is affixed will slide laterally to the right on shaft 32. Conversely, when the loading door 102 is closed, sleeve 62 will move leftward under the influence of spring 63 and loading impeller will enter the guide channel 103 in front plate 101. It is to be appreciated that impeller 60 at all times remains under the influence of flat spring 104 such that door 102 is at all times engaged therewith.

The operation of the device can now be described with the aid of FIGS. 3, 4, 5 and 6. Film is first loaded into the film guide grooves 44 of the loading section 24 and the door 102 is closed thereon. Upon the closure of door 102, sleeve 62 moves laterally leftward to a position where dog 78 is in a position to be contacted by projecting member 70. Upon continued rotation of center shaft 32, projecting member 70 contacts dog 78 and the loading impeller pushes the film along the film guide grooves 44 down towards the developer tank 16. The device is designed such that the various parts are then in the configuration depicted in FIG. 3. With further rotation of the center shaft 32, sleeve 58 is caused to move laterally leftward under the influence of the contact of wheel 80 with the sidewall of the drying chamber 22. At this time, the end wall 75 of slot 76 makes contact with projecting member 68 and causes it to move laterally leftward along with sleeve 58. Continued leftward movement of sleeve 58 thus causes continued leftward movement of projection 68 and key 66, whereby projecting member 70 is also caused to move laterally leftward and out of engagement with dog 78 of sleeve 62.

When projecting member 70 becomes disengaged from dog 78, the loading impeller 60 will be drawn upwards under the influence of the flat spring 104 associated with door 102. After the loading impeller 60 has returned to the door 102, continued rotation of shaft 32 causes wheel 80 to enter slot 90, whereupon spring 82 causes sleeve 58 and its associated impellers 50, 52, 54 and 56 to move laterally rightward until the end 77 of sleeve 58 impacts shock absorber 94. Impeller 50 will then be positioned directly over the film located in the film guide grooves 44 of the developer chamber 16. Slot 76 is formed of appropriate length such that the slot end 79 will contact the projecting member 68 immediately prior to the contact of the end 77 of sleeve 58 with shock absorber 94. Slot end 79 will then push key 66 back into its starting position to allow projecting member 70 to again engage dog 78 on a following revolution. It is noted that shock abosrber 94 and slip ring 96 both have slots 95 and 97 formed therein to permit the lateral movement of projecting member 70 therethrough.

To facilitate the action of the impellers, the loading impeller 60 is designed to rotate approximately 15° before the plane of the film impellers 50, 52, 54 and 56. This allows the loading impeller 60 to return to the door engaged position prior to the return of the film impeller 50.

It will therefore be appreciated that for each 360° revolution of the center shaft 32 the impellers 50, 52, 54 and 56 will make a 360° revolution through the spiral film course; at the end of which rotation, wheel 80 will arrive at return slot 90 and the impellers will slide laterally to the right to commence another 360° rotation. In each 360° rotation of the center shaft, the film in the film guide grooves 44 completes one spiralling rotation through the chamber 14. Thus, the film is pushed through the developer tank 16 by impeller 50, through the fixer tank 18 by impeller 52, through the wash tank 20 by impeller 54 and through the drying tank 22 by impeller 56. The film is pushed out of the film guide grooves 44 and into the holding tank 28 by impeller 56 prior to its entry into return slot 90. For each such 360° rotation, it is noted that loading impeller 60 rotates only approximately 42° under the influence of projecting member 70, after which projecting member 70 becomes disengaged from dog 78 and the loading impeller returns to its initial position on door 102.

A two speed gear assembly 34 as depicted in FIG. 6, is provided to speed the operation of the device. While many such two speed systems are known, the preferred embodiment utilizes a gearing arrangement having two interrelated sets of gears. The slow speed gear set comprising gears 114 and 116 is utilized during the portion of the 360° revolution where the film is submerged in a liquid. Suitable gears are to be utilized such that the film is submerged in the liquid for approximately 50 seconds to one minute. During the portion of a revolution where the film is out of the liquid and traveling through the top section of the device, high speed gears 118 and 120 are engaged to move the film in approximately 5 to 8 seconds. It is noted that the utiliziation of a two speed gear assembly as depicted in FIG. 6 will require the removal of several teeth from either of gears 114 or 116 to avoid the conflict of two engaged gear combinations having different gear ratios.

Figure 8:
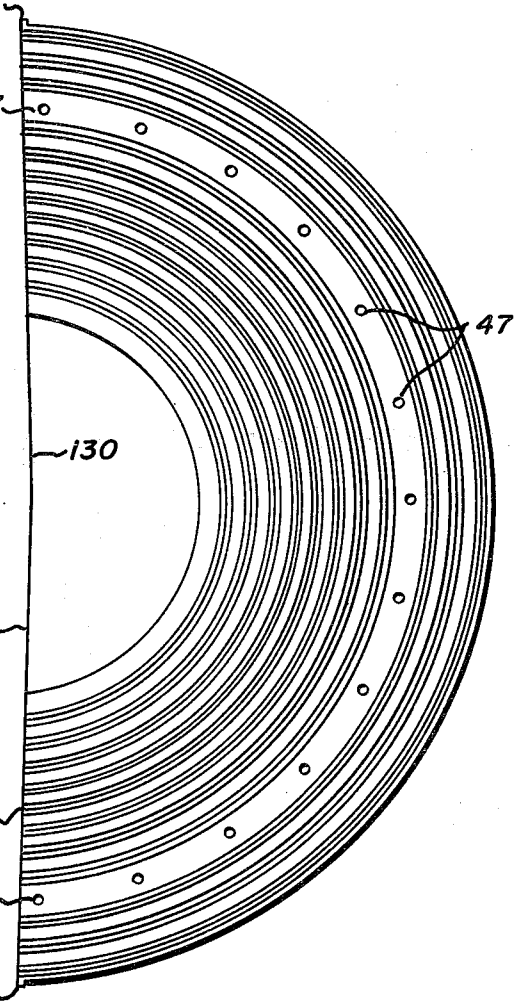
FIG. 8 is a front view of the spiral element depicted in FIG. 7.
Figure 7:
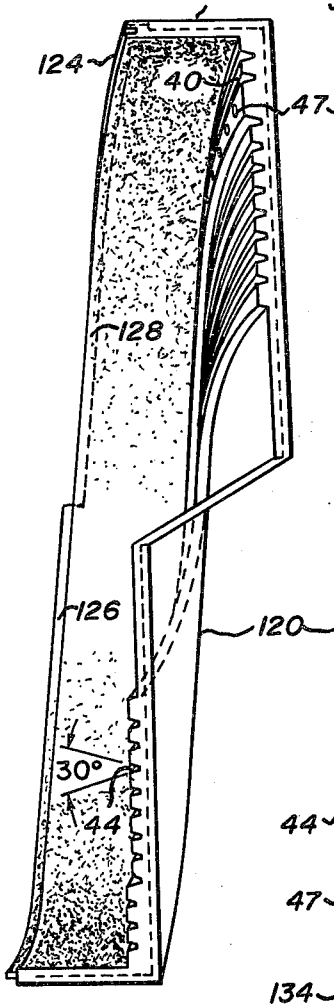
FIG. 7 is a side view of a spiral tank element utilized in the assembly of the instant invention.

FIGS. 7 and 8 depict two views of the element which is repeatedly utilized to assemble the spiral film chamber of the instant invention. As depicted therein, the element 120 comprises one half of a tank section such as the developer tank 16 depicted in FIG. 3. Each wall element 120 has an outer wall 122 which describes a semi-spiral as shown in FIG. 7. The outer wall section 122 emanates perpendicularly from the sidewall 40. The projecting edge 124 of outer wall 122 is formed with a tongue 126 and groove 128 configuration, the tongue 126 extending over one half of the projecting edge 124 and the groove 128 extending over the other half of the projecting edge 124. It is noted that the film guide grooves 44 are formed with edges which diverge at approximately a 30° angle to promote ease of film movement through the grooves. Peg holes 47 are formed at a constant radius along sidewall 40 to receive pegs 48 which join the midwall sections 46 to the sidewall 40. It is noted that sidewall 40 is curved and describes a 180° portion of the 360° spiral curve of each tank. It is to be appreciated that two such elements 120 can be rotated and joined together tongue to groove such that a completed two-walled lower tank section, such as the portion of developer tank 16 depicted in FIG. 3, can be simply and easily created. It is therefore to be realized that all of the tank and cross-over sections of the instant invention can be created from the joining together of several pairs of such elements 120. As shown in FIG. 8 the central edge 130 of element 120 is recessed 132 from what would be a true diametric line from the ends 134 of the circumference of element 120. This recessing is required to create the impeller return slot 90 as depicted in FIG. 5.

Figure 10:
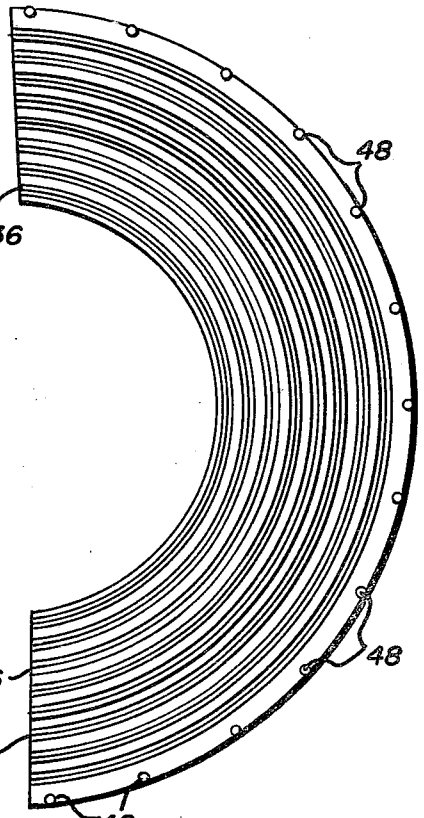
FIG. 10 is a front view of the mid-wall element depicted in FIG. 9.
Figure 9:
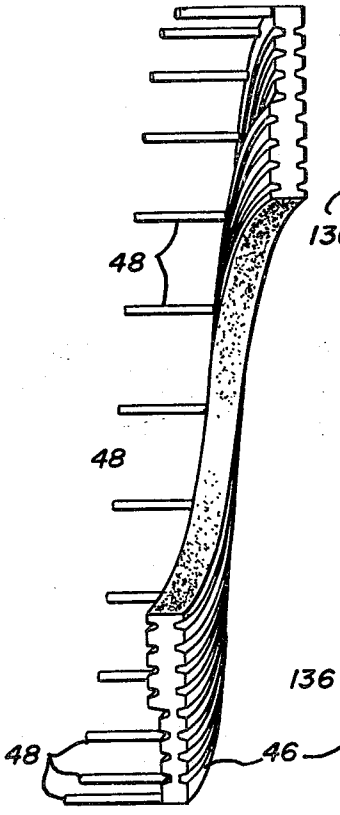
FIG. 9 is a side view of a mid-wall element of the instant invention.

FIGS. 9 and 10 show the mid-wall insert 66 in greater detail. As depicted therein, the mid-wall section 46 has pegs 48 which project laterally from the circumference of element 46. These pegs 48 are formed to penetrate holes 47 formed in sidewall 40 in order to secure the mid-wall element in the proper position. It is to be understood that mid-wall element 46 must be formed with the same spiralling shape as sidewall 40 to prevent film jamming. Additionally, the inner edge 136 must be recessed in the same manner as the inner edge 130 of sidewall 40 in order not to block slot 90 and prevent the movement of the impellers therethrough. It is to be recognized that a mid-wall insert 46 is to be joined to each sidewall 40 to form a complete mid-wall spiralling track through the spiral film channel of the device.

To speed the processing of the film, the developer tank and fixer tank may be heated by a simple heating element. An appropriate temperature is approximately 83° and a thermostat may be utilized to maintain this temperature.

When the film is being dried in the drying tank, it has been found to be more difficult to dry the edge of the film residing within the film guide grooves than to dry the more exposed cental areas of the film.

The blower 36 and heating element 38 are thus activated when the processor motor is activated to preheat the drying tank and its walls. A temperature of approximately 60° C. is appropriate for the drying tank. When the walls are thus preheated, there is no drying difficulty with the film edges.

Whereas, the preferred embodiments of the present invention have been described hereinabove, it is contemplated that other variations, alterations and modifications may become apparent to those skilled in the art after having read the above disclosure. It is therefore intended that the appended claims be interpreted as covering all such variations, alterations and modifications as fall within the true spirit and scope of the invention.

What is claimed is:

1. An apparatus for the automatic processing of dental x-ray film comprising:

means forming a spiralling film processing chamber, including at least four revolutions and having its principle axis disposed horizontally, such that one of four tanks suitable for individually retaining fluids is created by the lower portion of each said revolution, said spiralling chamber being defined by sidewalls having at least one pair of opposing arcuate grooves formed therein, each said pair of arcuate grooves being formed with a constant radius from the central axis of the spiralling chamber;

means forming a film loading port at one end of said spiralling chamber;

means forming a film exit port at the other end said spiralling chamber;

shaft means including a shaft disposed along the principle axis of the spiralling chamber, said shaft being rotatable by a motor; and impeller means carried by said shaft means for impelling film from said entry port through said spiralling chamber to said exit port.

2. An automatic processor for dental x-ray film as recited in claim 1 wherein said impeller means includes a plurality of film impellers each of which is rotatable through one of said tanks; and means coupling said film impellers to said shaft in spaced apart relation such that each film impeller is located in a different tank, said film impellers being axially slideable upon said shaft and rotatably driven through said tanks by rotation of said shaft.

3. An automatic processor for dental x-ray film as recited in claim 2 wherein said means for coupling said film impellers to said rotating shaft includes a sleeve concentric with said shaft and slideable thereon, said sleeve having said film impellers rigidly attached thereto, said sleeve further having a slot formed along a portion of its length; and said shaft having a radial projection extending through said slot in said sleeve.

4. An automatic processor for dental x-ray film as recited in claim 3 and further including means for axially actuating said sleeve upon rotation of said shaft means thereby causing said film impellers to move laterally as well as rotationally, whereupon, said film impellers describe a spiralling path within said spiralling chamber.

5. An automatic processor for dental x-ray film as recited in claim 4 wherein said means for axially actuating said film impellers includes a sidewall contacting member coupled to said impeller means and operative to keep said film impellers at a fixed distance from the sidewalls of said spiralling chamber.

6. An automatic processor for dental x-ray film as recited in claim 5 wherein radially extending return slots are formed in the sidewalls of said spiralling chamber, said slots being of sufficient size to allow said film impellers, the sleeve to which said film impellers are joined and said sidewall contacting means to pass therethrough and return from a film discharging position to a film engaging position.

7. An automatic processor for dental x-ray film as recited in claim 1 wherein said impeller means includes a loading impeller carried by said shaft means and rotatable from a first position external of said entry port, through said entry port to a second position internal of said entry port and operative to impel film loaded into said entry port to a starting position.

8. An automatic processor for dental x-ray film as recited in claim 7 and further including means coupled to said shaft and operative to drive said loading impeller from said first position to said second position one time during each revolution of said shaft.

9. An automatic processor for dental x-ray film as recited in claim 8 wherein means is provided to disengage said loading impeller from rotational engagement with said shaft and thereafter to place said impeller means in said film engaging position.

10. An automatic processor for dental x-ray film as recited in claim 1 wherein said shaft means includes drive means for creating two rotational speeds for said shaft, said drive means providing a slow rotational speed during that portion of a rotational cycle wherein film is being processed in a liquid, such as a developer, and a second rotational speed during that portion of a rotational cycle wherein film is traveling between liquids in succeeding tanks.

11. An automatic processor for dental x-ray film as recited in claim 1 and further including an air blower and air duct means to communicate blown air to one of said tanks, said air blower additionally having a heating element to warm said blown air.

12. An apparatus for the automatic processing of dental x-ray film comprising:

means forming a spiralling film processing chamber, including at least four revolutions and having its principle axis disposed horizontally, such that one of four tanks suitable for individually retaining fluids is created by the lower portion of each said revolution, said spiralling chamber being defined by sidewalls having at least one pair of opposing arcuate grooves formed therein, each said pair of arcuate grooves being formed with a constant radius from the central axis of the spiralling chamber;

means forming a film loading port at one end of said spiralling chamber;

means forming a film exit port at the other end of said spiralling chamber;

shaft means including a shaft disposed along the principle axis of the spiralling chamber, said shaft being rotatable by a motor; and impeller means carried by said shaft means for impelling film from said entry port through said spiralling chamber to said exit port;

said impeller means including a plurality of film impellers each of which is rotatable through one of said tanks, said impeller means also including, a loading impeller carried by said shaft means and rotatable from a first position external of said entry port, through said entry port to a second position internal of said entry port and operative to impel film loaded into said entry port to a starting position; and impeller coupling means for engaging said film impellers and said loading impeller during a portion of a rotation of said shaft and disengaging said film impellers from said loading impeller during other portions of a rotation of said shaft.

13. An apparatus for the automatic processing of dental x-ray film as recited in claim 12 wherein said impeller coupling means includes;

a film impeller sleeve concentric with said shaft and slideable thereon, said film impeller sleeve having said film impellers rigidly attached thereto, said film impeller sleeve further having a slot formed along a portion of its length;

a loading impeller sleeve concentric with said shaft and slideable thereon, said loading impeller sleeve having said loading impeller rigidly attached thereto, said loading impeller sleeve further having a dog axially projecting therefrom along said shaft;

a keyway formed longitudinally in said shaft;

a key formed to slideably reside in said keyway, said key having a projecting member formed thereon which projects radially from said shaft and engages said slot formed in said film impeller sleeve, said key having a second radially projecting member formed to engage said dog which projects from said loading impeller sleeve, said key, slot and dog being configured such that upon rotation of said shaft said projections from said key will engage said slot and said dog to cause said film impeller sleeve and said loading impeller sleeve to rotate with said shaft; and said slot, key and dog being further configured such that lateral movement of said film impeller sleeve will cause said key to move laterally therewith, whereupon the dog engaging projection of said key will become disengaged from said dog causing loading impeller to become disengaged from the rotational movement of said shaft.

* * * * *